US005679060A

United States Patent [19]

Leonard et al.

[11] Patent Number: 5,679,060

[45] Date of Patent: Oct. 21, 1997

[54] WAFER GRINDING MACHINE

[75] Inventors: Thomas E. Leonard, Morris Plains; John C. Pagano, Totowa, both of N.J.

[73] Assignee: Silicon Technology Corporation, Oakland, N.J.

[21] Appl. No.: 549,969

[22] Filed: Oct. 30, 1995

Related U.S. Application Data

[63] Continuation of Ser. No. 274,764, Jul. 14, 1994, abandoned.

[51] Int. Cl.[6] ..... B24B 1/00; B24B 7/19; B24B 7/30

[52] U.S. Cl. ..... 451/43; 451/41; 451/5; 451/285

[58] Field of Search ..... 451/43, 41, 44, 451/6, 285, 287, 288, 289, 290, 291, 5

[56] References Cited

U.S. PATENT DOCUMENTS

| | | | |
|---|---|---|---|
| 4,193,226 | 3/1980 | Gill, Jr. et al. | 51/124 R |
| 4,407,262 | 10/1983 | Wirz et al. | 451/6 |
| 4,638,601 | 1/1987 | Steere et al. | 451/44 |
| 4,653,231 | 3/1987 | Cronkhite et al. | 51/5 R |
| 4,680,893 | 7/1987 | Cronkhite et al. | 51/5 R |
| 5,036,624 | 8/1991 | Steere, Jr. | 451/43 |
| 5,036,628 | 8/1991 | Steere, III et al. | 451/44 |
| 5,076,021 | 12/1991 | Steere, Jr. | 451/43 |
| 5,329,732 | 7/1994 | Karlsrud et al. | 451/290 |
| 5,329,733 | 7/1994 | Steere, Jr. | 51/165.72 |
| 5,333,413 | 8/1994 | Hashimoto | 51/165.75 |
| 5,361,545 | 11/1994 | Nakamura | 451/290 |
| 5,498,199 | 3/1996 | Karlsrud et al. | 451/289 |
| 5,577,950 | 11/1996 | Smith et al. | 451/42 |
| 5,605,487 | 2/1997 | Hileman et al. | 451/5 |
| 5,616,063 | 4/1997 | Okumura et al. | 451/1 |

*Primary Examiner*—Timothy V. Eley
*Assistant Examiner*—Derris H. Banks
*Attorney, Agent, or Firm*—McAulay Fisher Nissen Goldberg & Kiel, LLP

[57] ABSTRACT

The wafer grinding machine uses a centrally located robot to move a wafer from an input station to a measuring station. Thereafter, the wafer is moved into a grind station and a wash station sequentially. The robot is able to move a wafer from the wash station to either the measuring station for after-grinding measurements or directly to an output station. During grinding of one wafer, a second wafer may be held between the measuring station and the grind station while a ground wafer is moved from the wash station to the measuring station for after-grinding measurements.

33 Claims, 6 Drawing Sheets

WAFER GRINDING MACHINE

This is a continuation of application Ser. No. 08/274,764, filed Jul. 14, 1994, now abandoned.

This invention relates to a wafer grinding machine. More particularly, this invention relates to an automated wafer edge grinding machine. Still more particularly, this invention relates to a method of automatically edge grinding a series of wafers.

As is known, the source material for manufacturing semi-conductor chips is usually a relatively large wafer, for example, of silicon. Generally, these wafers are obtained by slicing a cylindrical ingot, for example of pure silicon, into this pieces to obtain wafers with a circular periphery and a small flat in the periphery. The purpose of the flat is usually to provide for orientation of the wafer during subsequent operations.

After slicing from an ingot, the wafers require not only grinding of the peripheral edge to a particular profile, for example to a parabolic profile, to prevent cracking of the wafers during subsequent handling while avoiding sharp edges, but also grinding of the edge to a desired size and shape.

Heretofore, various types of techniques have been employed to edge grind a wafer intended for the semiconductor industry. In one case, a grinding wheel is held against a wafer under a spring bias in order to grind the edge to the appropriate shape. However, with this technique, should a wafer not be truly circular, the spring-biased grinding wheel is unable to accurately grind the wafer to a true circular periphery.

A second technique utilizes machines which employ a cam representative of the wafer shape and a grinding wheel on a cam follower which is held by a weight and pulley to apply a constant force on a wafer to be ground. With this technique, material is removed from a wafer until the cam and cam follower are in contact for one complete revolution. However, this type of technique is cumbersome and, because of the mechanical linkages between the various components, requires a relatively large amount of space. Further, should the size of wafer being ground be changed, for example, from a three inch to a four inch or six inch wafer, the various mechanical linkages require substantial adjustment in order to accommodate the differently sized wafers.

A still further technique has been known from U.S. Pat. No. 4,638,601 in which a series of wafers can be accurately edge-ground in a sequential manner. However, the edge grinder described generally moves a wafer in a rectilinear in-line manner from a wafer unloading station through a series of measuring, sensing and grinding stations to a loading station. As a result, the overall grinding machine may occupy a relatively large space. Further, in the event that one wishes to inspect a ground wafer for accuracy, the wafer must either be inspected on a separate machine or returned to the measuring station upstream of the grind station. In the first case, the expense of a second machine is required along with the resulting down-time required to carry out an inspection. In the second case, the operation of the automatic grind machine must be interrupted to the extent necessary to carry out an inspection operation in the measuring station.

Accordingly, it is an object of the invention to provide a wafer grinding machine which out-performs all present edge grinding machines.

It is another object of the invention to reduce the user cost per wafer in grinding a series of wafers.

It is another object of the invention to improve the quality of a wafer having an edge ground in a wafer grinding machine.

It is another object of the invention to reduce the cost of manufacturing a wafer grinding machine.

It is another object of the invention to provide a wafer grinding machine which occupies a relatively small space.

It is another object of the invention to provide a wafer grinding machine which is easy to use and which provides an optimum of operator safety.

Briefly, the invention provides a wafer grinding machine for grinding a series of wafers as well as a method of edge grinding a series of wafers.

The wafer grinding machine is constructed to operate in an automated manner and comprises a wafer measuring station for determining the size and shape of a wafer; a grind station for grinding an edge of a wafer received from the wafer measuring station to a predetermined size and shape and a wash station for washing an edge ground wafer received from the grind station.

The grinding machine further includes a robot which is disposed centrally of the measuring station, grind station and wash station and which has an arm for conveying a wafer. In addition, a control means is provided for programming the robot to move the arm to the measuring station in order to deliver a wafer for processing. The control means also programs the robot to move the arm between the wash station and the measuring station in order to return a ground wafer to the measuring station for inspection of the accuracy of the ground edge of the wafer. In this way, after a wafer is ground in the grind station, the wafer can be checked for accuracy. Thus, the same machine may be used not only for grinding but also for inspection of the ground wafer. Accordingly, there is no need for a second inspection machine and the related costs for such.

The grinding machine is also provided with at least one wafer input station for holding a stack of wafers and at least one wafer output station for holding a stack of ground wafers. Further, the control means programs the robot so as to selectively move the arm between the input station and the measuring station so as to transfer a wafer into the measuring station. The control means also programs the robot to selectively move the arm between the wash station and the output station or from the wash station to the measuring station and thence to the output station. In this respect, not every wafer need be inspected for accuracy. For example, the control means may program the robot to move every fifth ground wafer from the wash station to the measuring station in order to inspect the accuracy of the ground edge of the wafer. On the other hand, should a ground wafer not pass inspection, the robot may be programmed to begin transferring every wafer from the wash station to the measuring station for inspection.

The measuring station is constructed to determine the size and shape of a wafer in a non-contact manner. In this respect, the measuring station includes a probe means which performs a non-contact measurement of the diameter, flat length, notch depth (if any) and the angles between features of a received wafer. In this respect, the probe means provides for measurements of the wafer edge as the wafer is rotated and, in particular, measures the distance from the center of wafer rotation to the wafer periphery in relation to the angular position of the wafer. Thus, one full rotation describes the wafer shape and location. The probe means delivers corresponding signals in response to the obtained measurements to a processing means, which, in turn, determines the shape and geometric center of the wafer from the information received from the signals. The processing means is thus able to determine the actual size and shape of the wafer as well as the position of the geometric center of the wafer. In addition, the processing means serves to rotate the chuck of the measuring station so as to place the geometric center of the wafer on a rectilinear path leading to the grind station.

The measuring station may also be provided with a means to determine the thickness of the wafer at a plurality of points so as to determine the taper of the wafer.

The grinding machine also includes a conveyor for moving a wafer from the measuring station to the grind station along a rectilinear path as well as a second conveyor for moving a ground wafer from the grind station to the wash station in a path transverse to the first rectilinear path. In this regard, the orientation of the working stations of the machine permit the robot to move a ground wafer from the wash station back to the measuring station over a limited path of travel. Further, the overall footprint of the grinding machine is reduced as compared to an in-line arrangement of stations in a grinding machine.

The grind station of the machine may be provided with a grind wheel for grinding the edge of a wafer so as to have a flat on the edge as well as with a grind burr to provide a notch in the edge of the wafer. For example, a notch grind station similar to that as described in U.S. Pat. No. 5,036,624 may be used.

The grind wheel for the grind station may also have multiple peripheral grind grooves disposed in vertical relation. In this regard, one of the grooves has diamonds sized to provide a coarse grind while the other grooves are sized with diamonds to provide a fine grind. A suitable means is also provided for moving the grind wheel vertically to align a respective groove with the wafer in order to carry out a grind operation.

The wash station of the machine is provided with a rinsing means which serves to spray water or other suitable washing liquid onto the top and bottom surfaces of the ground wafer in order to clean debris from the wafer surfaces. In addition, a means is provided for blowing air onto the wafer after rinsing in order to air dry the wafer. During this time, the wafer may be rotated at a high speed to enhance the air-drying of the wafer as well as to spin off debris by centrifugal force.

The method of edge grinding a series of wafers comprises the steps of moving a first wafer into a measuring station to measure at least the shape, size, location and thickness of the wafer. Next, the measured wafer is moved from the measuring station into the grind station for grinding of the peripheral edge of the wafer to a predetermined size and shape. Thereafter, the edge ground wafer is delivered to the wash station to clean debris from the ground wafer.

In accordance with the invention, the cleaned wafer is selectively moved from the wash station into the measuring station to measure the size and shape of the ground wafer and then passed to the output station or is delivered directly from the wash station into the output station. Further, the third wafer can be moved to a holding position between the measuring station and grind station while the first wafer is returned to the measuring station for after-grind measurement and thence moved to the output station.

In accordance with the method, a second wafer is moved into the measuring station while the first wafer is in the grind station. In addition, a third wafer is moved into the measuring station when the first wafer is in the wash station and the second wafer is in the grind station.

Typically, the grinding of a wafer requires substantially more time than the measuring and washing of a wafer. Accordingly, during the grinding of one wafer, a wafer from the wash station may be returned to the measuring station for inspection purposes. After inspection, the wafer can be removed to the output station. Thus, the output of a machine can be maximized as the cycle times for the wafers in a series of wafers may overlap.

These and other objects and advantages of the invention will become more apparent from the following detailed description taken in conjunction with the accompanying drawings wherein.

Figure 1:
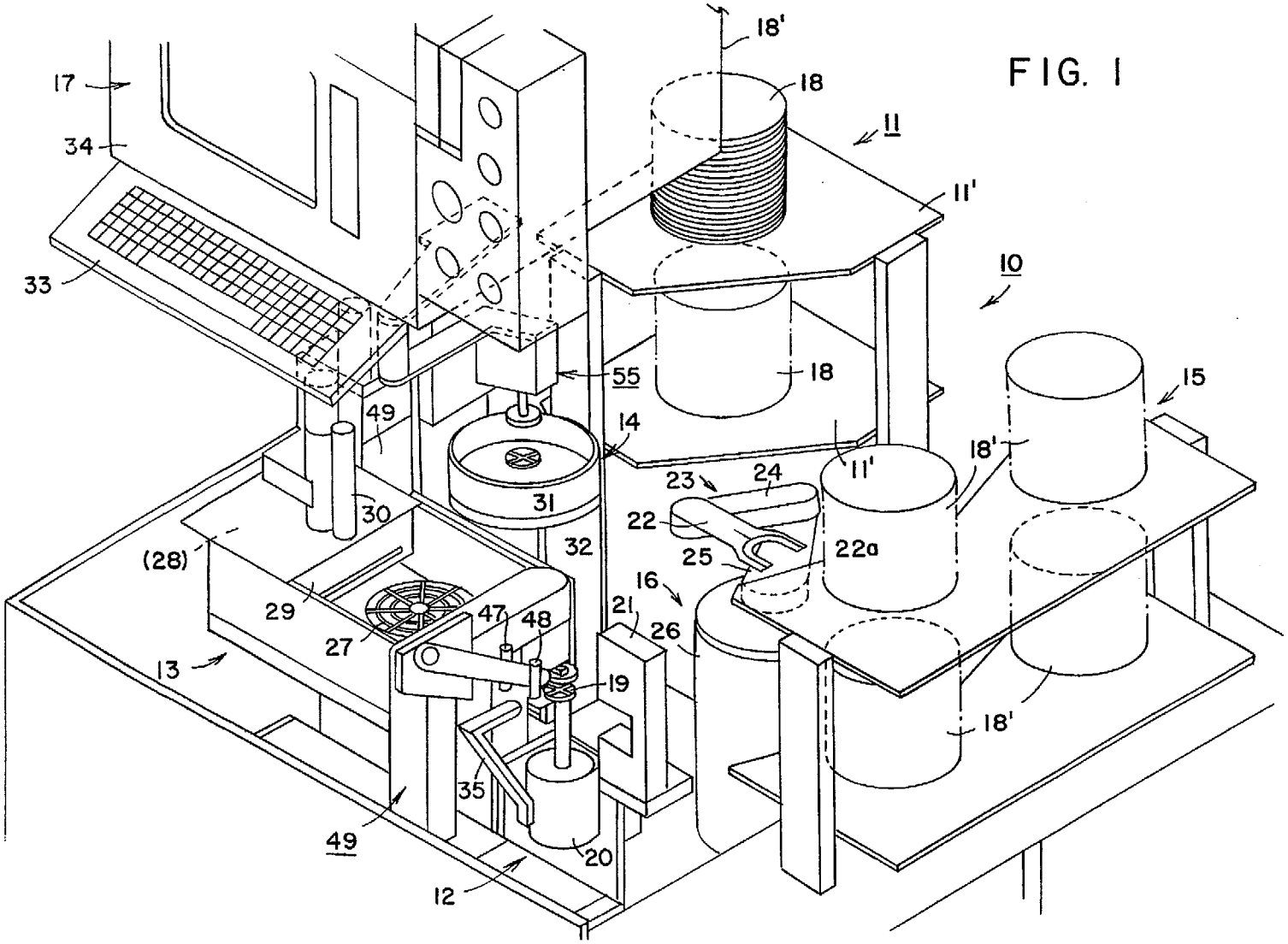
FIG. 1 illustrates a perspective view of the top of a wafer grinding machine constructed in accordance with the invention.

Referring to FIG. 1, the wafer grinding machine 10 includes at least one wafer input station 11, a wafer measuring station 12, a grind station 13, a wash station 14 and at least one output station 15. In addition, the grinding machine 10 employs a robot 16 which is disposed centrally of the stations 11–15 as well as a control means 17 for programming the robot 16.

Referring to FIG. 1, the input station 11 is constructed to hold at least one vertical stack of wafers. In the illustrated embodiment, the input station 11 has a pair of platforms 11' to receive two cassettes of wafers 18 which are vertically disposed on a common vertical axis 18".

The wafers which are delivered to the input station in the cassettes 18 are typically wafers which have been sliced from an ingot and which require edge grinding to a predetermined shape and size usually including at least one flat or one notch for orientation purposes as is known. In addition, the wafers may require edge grinding to a desired profile. The following description of the machine 10 will be directed to wafers which are received having a flat or a notch and which are to be edge ground into a finished wafer. However, it is to be recognized that the machine may be used to grind a wafer without a flat and/or without a notch. The machine may also be used to grind more than one flat and more than one notch into a wafer as desired.

Figure 2:
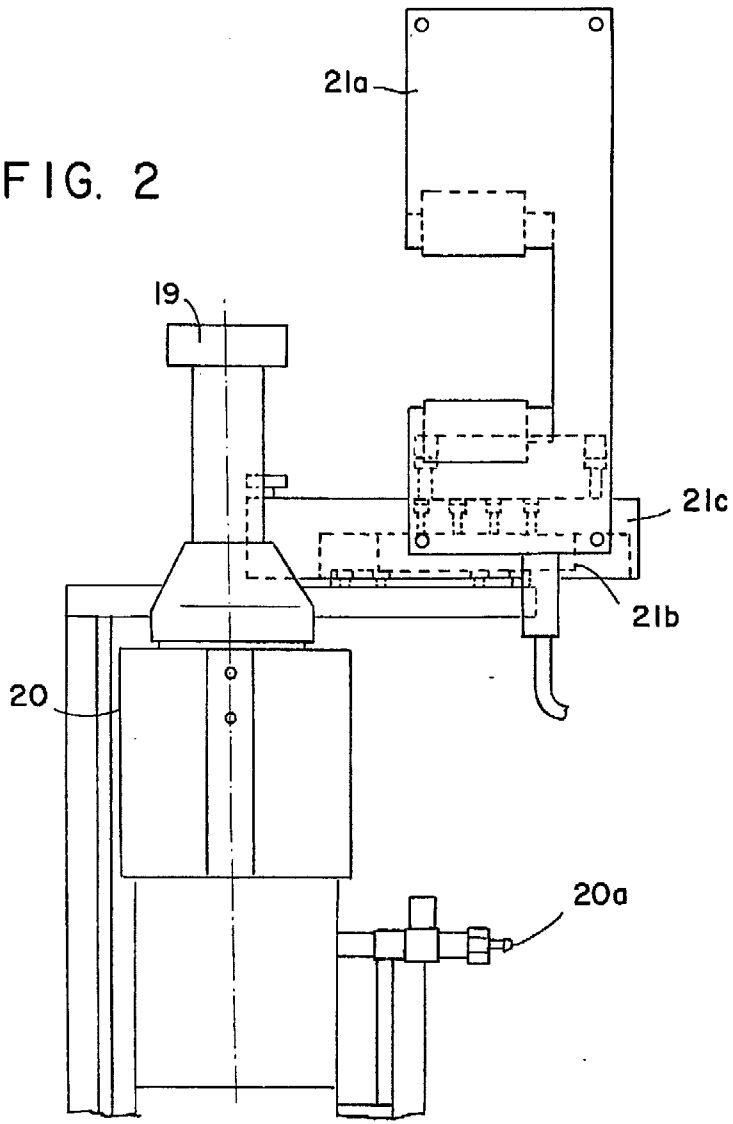
FIG. 2 illustrates a side view of the measuring station.

Referring to FIGS. 1 and 2, the wafer measuring station 12 is employed for determining the size and shape of a wafer delivered thereto. To this end, the measuring station 12 has a chuck such as a vacuum chuck 19 for receiving a wafer thereon and a drive 20 for rotating the chuck 19 about a vertical axis with the wafer received thereon. For example, the chuck may be constructed in a manner as described in U.S. Pat. No. 4,638,601, that is, the chuck 19 includes a vacuum head for holding a wafer thereon.

By way of example, the drive 20 may be motor driven and includes a barb connector **20*a* for connecting the drive 20 to a vacuum source which cooperates to supply vacuum to the vacuum chuck 19**.

In addition, a probe means 21 is provided in the wafer measuring station 12 for measuring the wafer received from the input station 11. In this respect, the probe means 21 includes an infra-red semi conductor laser (IEC class 1) which is in the form of a laser scan micrometer which performs a non-contact measurement of the diameter, flat length, notch depth (if any) and angles between features of a received wafer. The laser allows for quick and accurate measurements of the wafer edge as the wafer is rotated. In addition, the probe means generates a sequence of signals in response to the sensed edge of the wafer as the wafer is rotated. That is, the probe means measures the distance from the center of wafer rotation to the wafer periphery in relation to the angular position of the wafer. Thus, one full rotation describes the wafer shape and location. These signals are passed to a processing means (not shown) which determines the size, the shape and the geometric center of the wafer from the signals which are received.

The information which is received in the processing means (not shown) is essential for wafer placement in the grind station and allows the machine to omit grinding of a wafer if the wafer falls outside of the "user enter" limits on the incoming wafer. For example, the processing means (not shown) can be programmed via a keyboard by a user so as to not process a desired ground diameter of 200.000 millimeters with an incoming wafer measuring 199.550 millimeters.

Referring to FIG. 2, the probe means 21 includes a probe sensor bracket 21*a* which is adjustably mounted via a linear slide bearing 21*b* on a bearing block 21*c*. Thus, when a wafer is in place on the chuck 19, the probe sensor bracket 21*a* is stationary. However, if the wafer being processed is of a greater or lesser diameter, the probe sensor bracket 21*a* may be adjusted to the size of the wafer by moving it from one position to another position relative to the chuck 19.

The processing means (not shown) functions in a manner similar to that as described in U.S. Pat. No. 4,638,601 in order to determine the actual size and shape of the wafer and to locate the flat, notch and geometric center and need not be further described.

The processing means is connected with the chuck 19 to deliver a signal thereto in order to rotate the chuck 19 an amount sufficient to place the geometric center of the received wafer on a rectilinear path extending from the measuring station 12 to the grind station 13.

Figure 3:
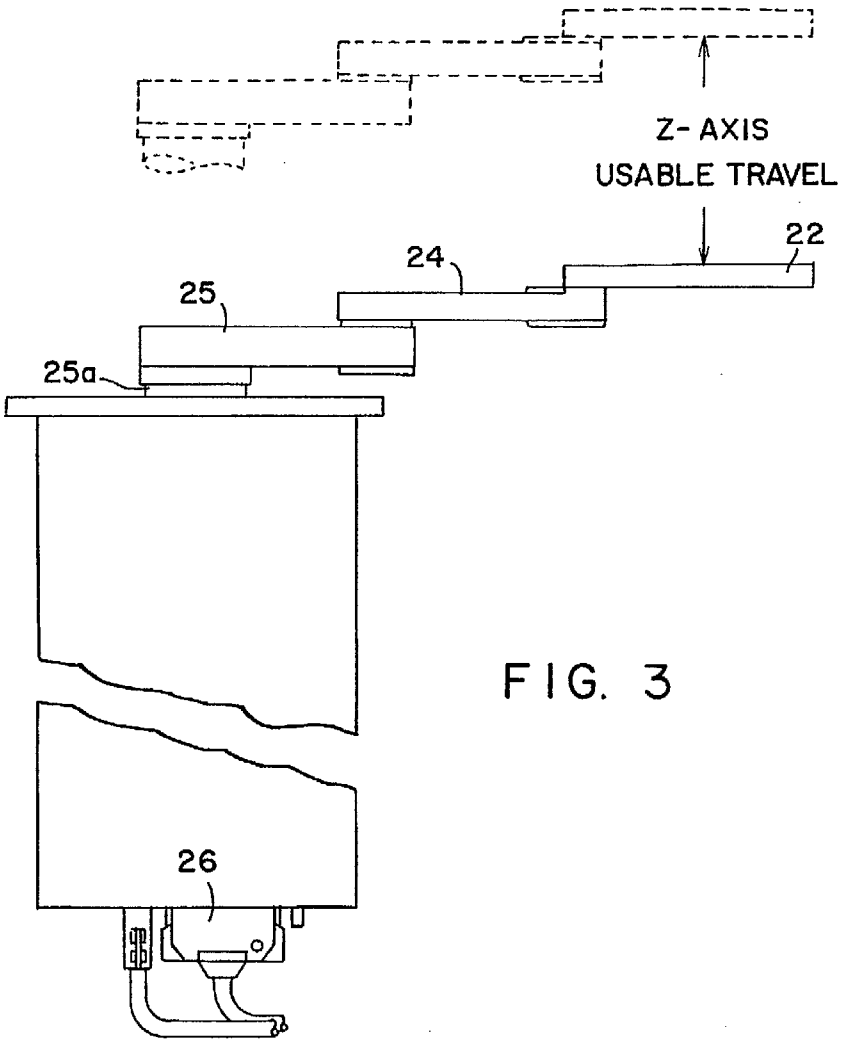
FIG. 3 illustrates a side view of the centralized robot.

Referring to FIGS. 1 and 3, the robot 16 includes an arm 22 in the form of a spatula or fork-like member for conveying a wafer thereon and an articulated lever means 23 which is rotatable about a central vertical axis of the robot 16. As indicated, the lever means 23 includes a pair of levers 24, 25 and the spatula arm 22. The innermost lever 25 is rotatably mounted on the central vertical axis of the robot 16 while the second lever 24 is mounted on the end of the first lever 25. The spatula arm 22 is, in turn, pivotally mounted on the second lever 24. The spatula arm 22 and the levers 24, 25 are interconnected by mechanical means (not shown) such that the articulated lever means 23 always moves the spatula arm 22 in a linear motion coincidental with the longitudinal axis of the spatula arm 22. This axis, in turn, is arranged to intersect with the central vertical axis of rotation of the lever means 23 and the robot 16.

The spatula 22 is provided with a groove 22*a* which extends through each prong of the fork-like structure and which communicates with a source of vacuum via a suitable pneumatic line (not shown). In this regard, the spatula 22 serves to hold a wafer thereon under a suction force.

During operation, the spatula 22 receives a wafer such that the center of the wafer generally coincides with the center of the opening defined by the spatula 22. In addition, the spatula 22 moves so that the center of the spatula 22 is always disposed on a radius extending from the center of the shaft 25*a* on which the lever system 23 is mounted. That is to say, the spatula 22 moves in a rectilinear path. To this end, the robot 16 is provided with three motors (not shown). One motor 26 is used to rotate the lever system 23 about the vertical axis of the robot 16. The second motor serves to raise and lower the lever system 23 and spatula arm 22, particularly with respect to the receiving and sending cassettes. The third motor serves to rotate the lever arms 24, 25. In this respect, the motor is interconnected via a pulley (not shown) to the lever arms 24, 25 and the spatula arms 22 so that the spatula arm 22 is always moved on a radius passing through the center of rotation when moving between the respective stations 11, 12, 14, 15. In this way, spatula arm 22 which carries the wafer may have the necessary two degrees of freedom to move linearly and also rotate in a horizontal plane.

The robot 16 and, particularly, the levers 24, 25 and the spatula arm 22 are controlled by the control means 17 to carry out the linear and rotational motion. Thus, depending upon the program delivered via the control means 17, the lever means 23 and the spatula arm 22 may rotate about a central vertical axis so as to align the longitudinal axis of the spatula arm 22 with the centerline of the process station desired. In this way, the arm 22 is programmed to pick up a wafer from a cassette 18 in the input station 11 and to move the wafer to the chuck 19 of the measuring station 12. The control means 17 also is able to program the robot 16 so that the arm 22 is able to move from the wash station 14 back to the measuring station 12 for reasons as described below or directly to the output station 15 so as to deliver a washed wafer into a cassette 18' located thereat as described below.

The robot 16 is constructed so that the arm 22 and articulated lever means 23 can be moved vertically so as to remove selected wafers from a cassette 18. This is a third degree of movement provided by the robot 16. Thus, the central vertical shaft of the robot 16 elevates as well as rotates.

The measuring station 12 is also provided with a means for measuring the thickness of a wafer in the measuring station 12 and, particularly, when the wafer is located on the chuck 19.

Figure 4:
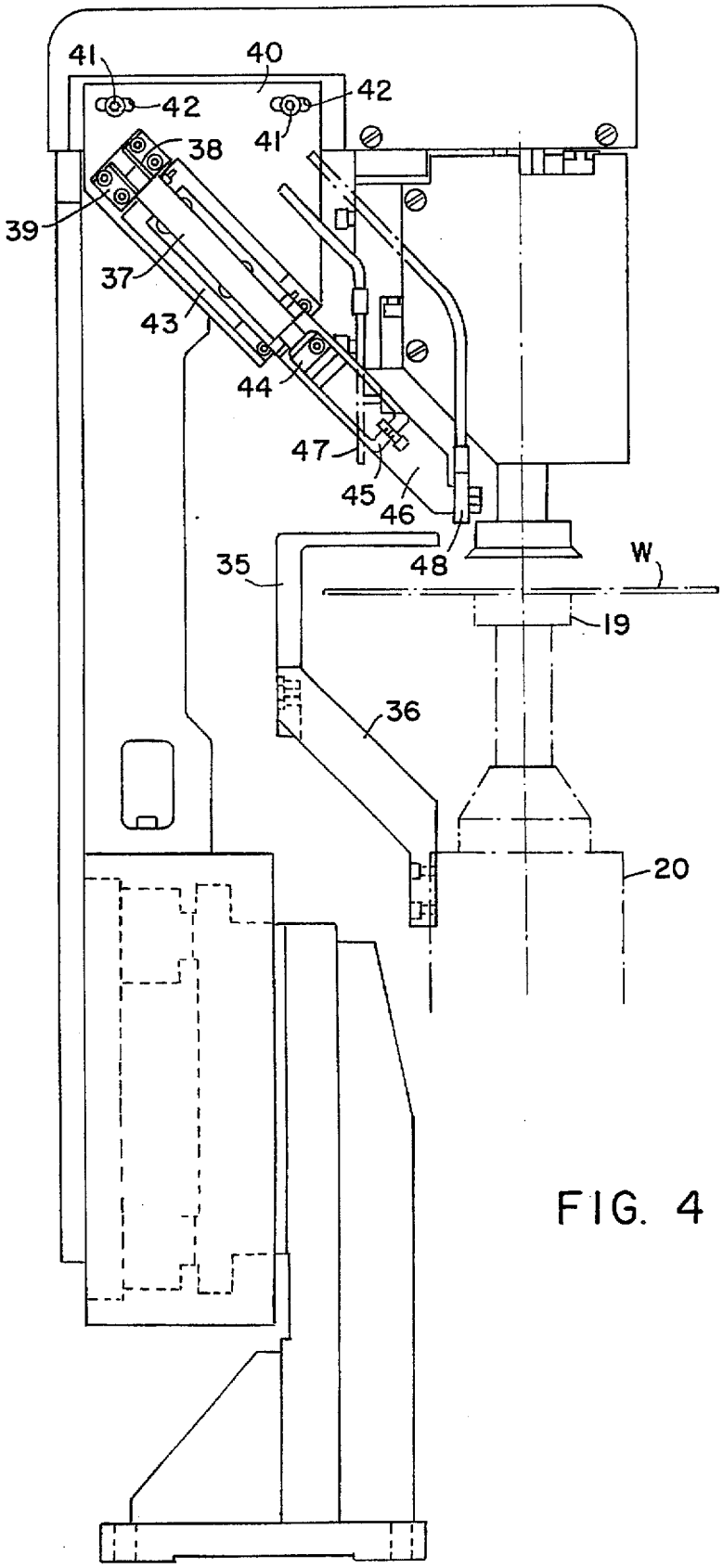
FIG. 4 illustrates a side view of the thickness measuring means.

Referring to FIGS. 1 and 4, the thickness measuring means includes a gauge bar 35 which is fixedly mounted on the frame for the motor 20 of the chuck 19 so as to establish a fixed datum plane relative to the surface of the chuck 19. As indicated, the gauge bar 35 has a horizontal portion which is located above the plane of a wafer on the chuck 19. Typically, the gauge bar 35 is of L-shape and is mounted via a bracket 36 on the frame for the motor 20. In this way, the upper surface of the gauge bar 35 is at a known elevation relative to the top surface of the chuck 19.

The thickness measuring means also includes an air cylinder 37 which is pivotally mounted at the upper end via a pivot 38 on a block 39. This block 39 is, in turn, mounted on a plate 40 secured to the frame of the machine in fixed manner, for example via a pair of screws 41 which pass through elongated slots 42 in the plate 40.

A linear slide bearing 43 is mounted under the cylinder 37 and is interconnected via a clamp 44 with the piston of the air cylinder 37 so as to be reciprocated thereby. An adjustable stop 45 is secured to the lower end of the cylinder 37 to limit the movement of the piston.

An arm 46 is slidably mounted on the linear slide bearing 43 and is connected to the clamp 44 of the air cylinder 37 so as to be reciprocated along the slide bearing 43. This arm 46 is provided with suitable bores to support a pair of sensors 47, 48 therein. As indicated in FIG. 4, each sensor 47, 48 is vertically disposed in parallel relation to the other while being spaced apart from each other. In addition, each sensor 47, 48 has a lower surface in a different horizontal plane from the other.

The uppermost sensor 47 is positioned above the horizontal gauge bar 35 so as to measure the distance therebetween. The second sensor 48 which is located at the end of the arm 46 is mounted over a wafer W on the chuck 19 outside of the contour of the gauge bar 35 and near to the center of the wafer so as to measure the distance between the sensor 48 and the wafer W.

The air cylinder 37 is connected to a suitable pneumatic source so as to be driven pneumatically.

The thickness measurement of a wafer on the chuck 19 is performed by activating the air cylinder 37 so that the two sensors 47, 48 come into close proximity to the gauge bar 35 and the wafer W. The two sensors 47, 48 are of a non-contacting type with the uppermost sensor 47 being deemed the "reference sensor" which measures the distance to the gauge bar 35 (reference bar) so that the actual position of the second sensor 48 is known.

The lowermost sensor 48 measures the distance to the top surface of the wafer. Since the bottom surface of the wafer W is on the vacuum chuck 19, i.e. at a fixed location, differences in distance as detected by the sensor 48 in combination with the differences of the reference and sensor 45 output will yield the wafer thickness variations.

After the sensors 47, 48 have obtained their readings, the air cylinder 37 is actuated to retract the arm 46 with the sensors 47, 48 thereon in order to permit the wafer to be picked up and moved to the grind stage.

The thickness is typically measured at the center of rotation of the measuring station (probe chuck) which is approximately the center of the wafer. However, by moving the transport stage in a rectilinear path in combination with the rotation of the chuck 19, the thickness of any desired point on the wafer can be obtained. It is advantageous to measure thickness at the station due to the fact that any point on the wafer is readily available and since the wafer orientation is known by the probe measuring station, the thickness points obtained can be related to a feature on the wafer (e.g. a flat or notch). It is also advantageous to measure the thickness at a common station and not require a separate station. Also, thickness measurements can be made simultaneously with the wafer probing measurements.

Figure 5:
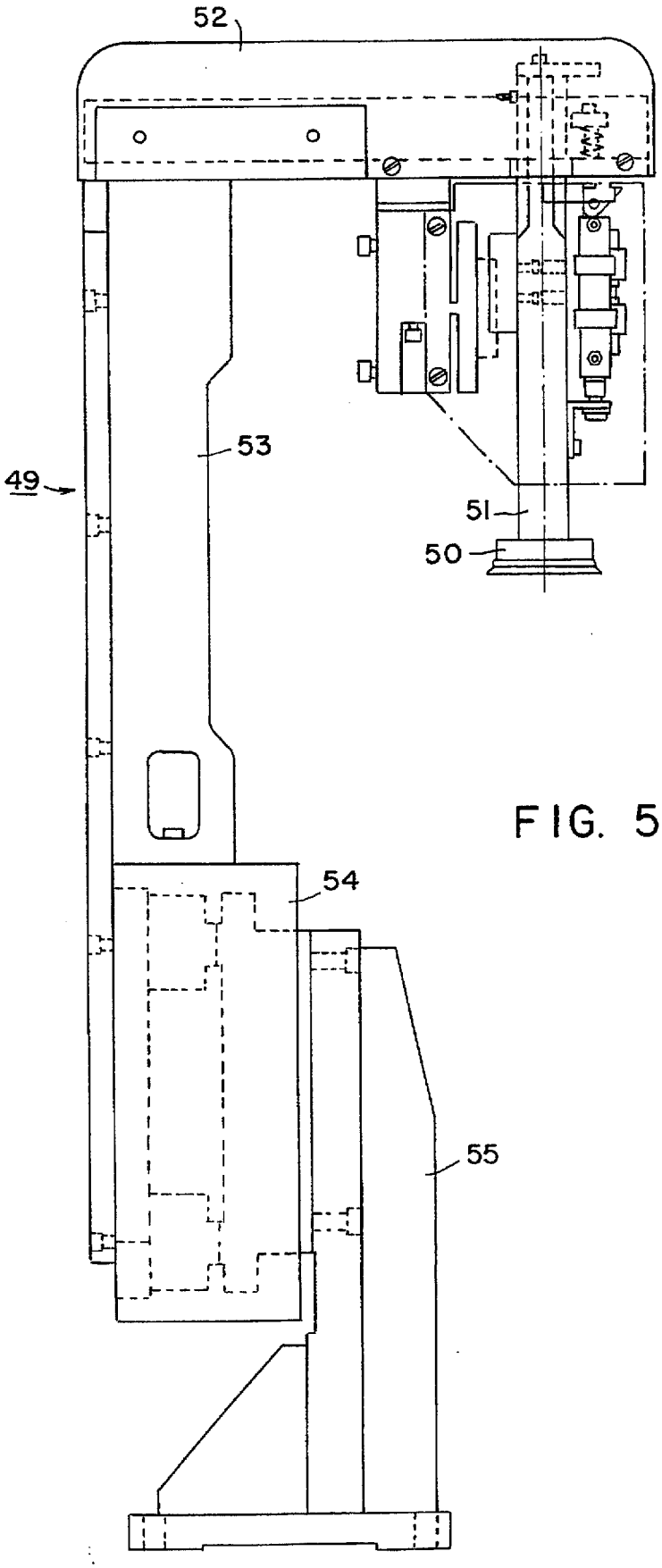
FIG. 5 illustrates a side view of a conveyor for moving a wafer from the measuring station to the grind station.

Referring to FIGS. 1 and 5, a conveyor 49 is provided for moving a wafer from the measuring station 12 to the grind station 13 along the rectilinear path extending therebetween. As indicated in FIG. 5, this conveyor 49 includes a vacuum head 50 which is mounted on a vertically disposed shaft 51 which, in turn, is mounted in a horizontally disposed structure 52. As indicated, the structure 52 is mounted on a vertical support 53 which is parallel to the shaft 51. The vertical support 53 is, in turn, mounted on a transport linear stage assembly 54 so as to move in a rectilinear manner along a support 55 in order to move a wafer from the measuring station 12 to the grinding station 15.

The conveyor chuck 50 is programmed to move downwardly onto a wafer received on the chuck 19 on the measuring station 12. Thereafter, the conveyor 49 is programmed so that the chuck 50 picks up a wafer so as to move vertically along a Z-axis. Next, the conveyor 49 moves parallel to the rectilinear path via the linear stage 54 along a Y-axis into the grind station 13. The chuck 50 is then moved downwardly to deposit the wafer into the grind station 13 as described below.

Figure 6:
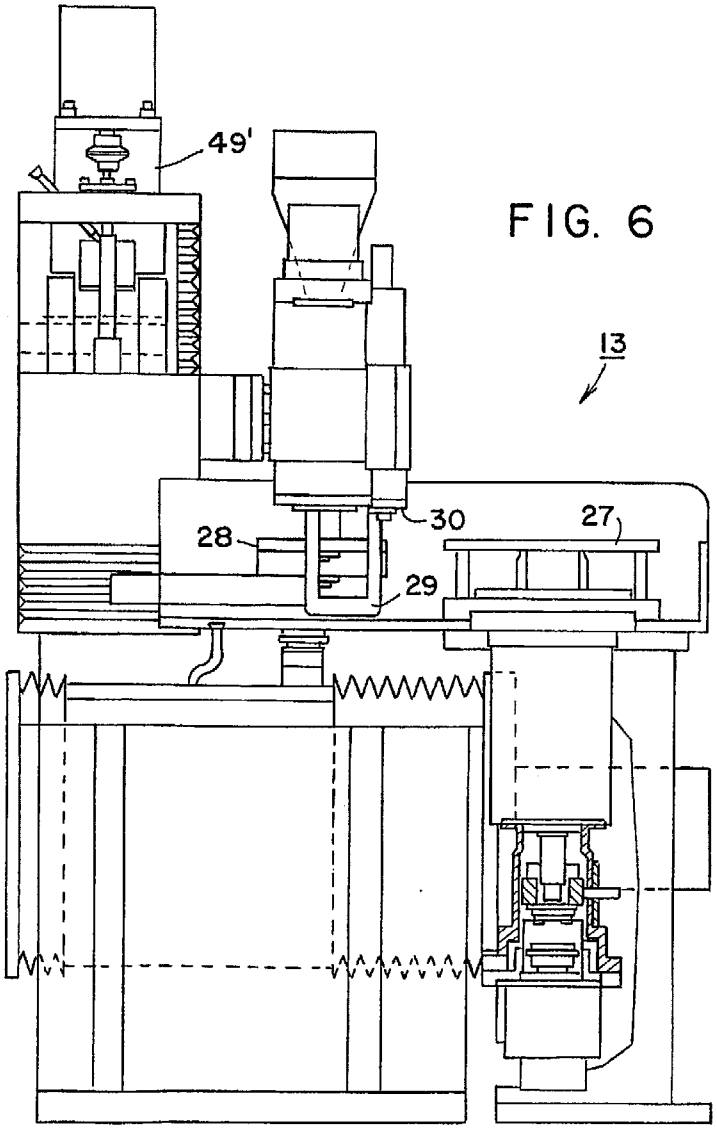
FIG. 6 illustrates a front view of a grind station.

Referring to FIGS. 1 and 6, the grind station 13 is constructed in a manner similar to that as described in U.S. Pat. Nos. 5,036,624 and 5,076,021. For example, the grind station 13 includes a rotatable chuck 27 for receiving the wafer from the conveyor and for holding and rotating a wafer thereon about a vertical axis perpendicular to and in the rectilinear path common to the measuring station 12. In addition, a grind wheel 28 is provided within a housing 29 to rotate about a second axis parallel to the vertical axis of the chuck 27. As indicated, the housing 29 has a slot or window therein to receive a peripheral edge of a wafer on the chuck 27. The window (not shown) may also include a seal means such as described in U.S. Pat. No. 5,036,628.

Referring to FIG. 6, the housing 29 of the grind stage 13 is mounted as described in U.S. Pat. No. 5,036,624 so as to be moved towards and away from the chuck 27 via suitable means in order to have the grind wheel 28 grind a peripheral edge of a wafer on the chuck 27. This means for moving the housing 29 is also coordinated with the rotation of the wafer on the chuck 27 as is known in order to grind a flat on the wafer. That is, the Y-axis movement of the grind wheel is coordinated with the location of the wafer. One benefit of using such a coordinated motion is a reduced cost and component complexity relative to an arrangement where the grind wheel would move along an X-axis of motion to grind a flat.

As shown in FIG. 6, a grind burr 30 is also rotatably mounted on the housing 29 about a vertical axis parallel to the axis of the grind wheel while also being located in the rectilinear path extending from the measuring station 12. The means for moving the grind wheel also serves to move the grind burr along the rectilinear path in order to grind the notch in the wafer on the chuck 27. Again, the grind burr may be mounted and operated in a manner as described in U.S. Pat. No. 5,036,624.

The grind wheel 28 may have at least a pair of peripheral grind grooves which are disposed in vertical relation. One of the grooves, for example, the lower groove, may be sized to provide a coarse grind while the other groove is sized to provide a fine grind. A means 49' is also provided for moving the grind wheel vertically to align a respective groove with a wafer on the chuck 27.

Each or both grooves of the grind wheel may be shaped to impart a desired profile to the edge of the wafer, for example, a parabolic profile in order to eliminate sharp corners.

Figure 7:
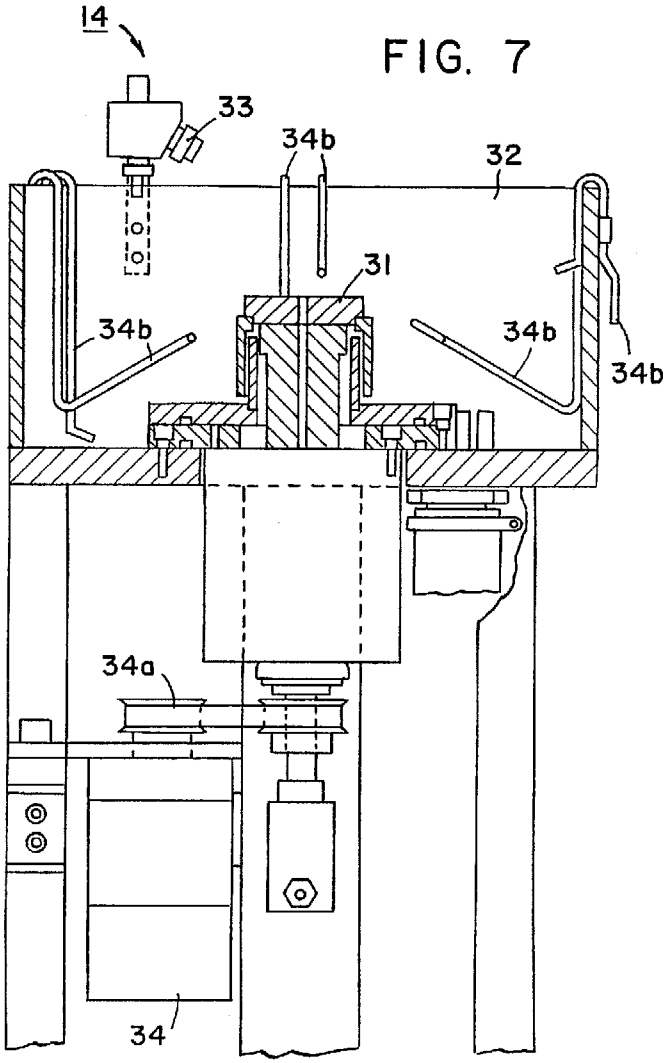
FIG. 7 illustrates a part cross-sectional view of the wash station.

Referring to FIGS. 1 and 7, the wash station 14 includes a chuck 31 for receiving a ground wafer thereon. For example, the chuck 31 is in the form of a vacuum chuck for securely holding the wafer thereon.

The wash station 14 also includes a tank 32 which receives and surrounds the chuck 31. The tank 32 cooperates with a washing means 33 which serves to spray water or other suitable washing liquid onto a wafer on the chuck 31 in order to rinse debris from the wafer.

The wash station 14 also includes a means in the form of a motor 34 for rotating the chuck 31 via a belt drive **34*a* at a speed sufficient to spin-dry a wafer which has been rinsed with the rinsing solution. In addition, a means for blowing air onto the wafer is also provided within the wash station 14 in the form of tubes 34*b* directed at the top and bottom of the wafer in order to air dry the wafer. Any debris and rinse liquid which is spun off the wafer is collected within the tank 32** and is drawn off, for example via vacuum to a suitable reservoir or drain means.

During operation, wash fluid, e.g. water, is passed through a nozzle of the washing means 33 onto the wafer. Subsequently, air is delivered through the series of tubes **34*b* onto the lower side and upper side of the wafer so as to air dry the wafer. At the same time, the chuck 31 can be rotated via the motor 34** at a high rate of speed to spin dry the wafer.

Figures 8, 9:
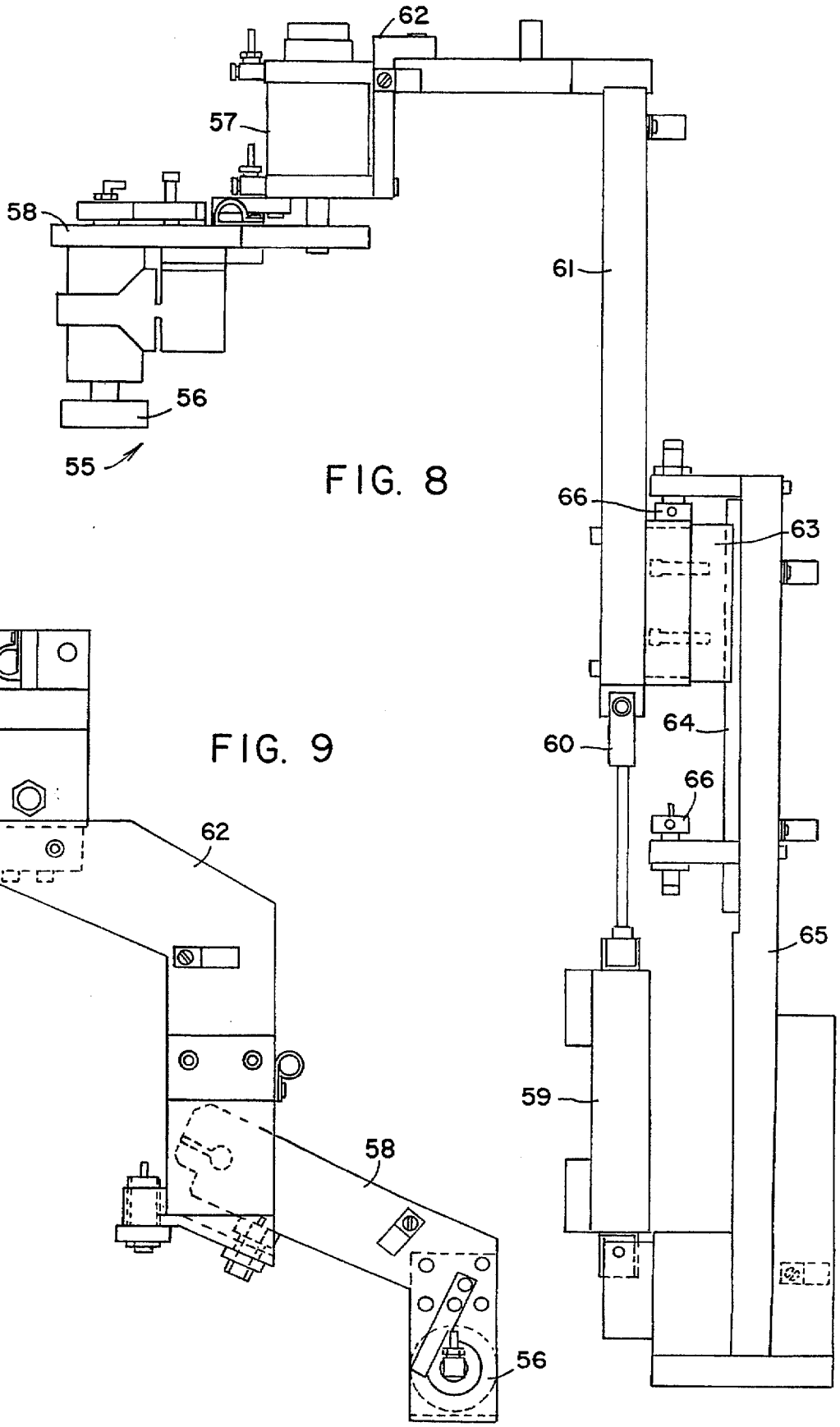
FIG. 8 illustrates a side view of a conveyor for moving a ground wafer from the grind station to the wash station.
FIG. 9 illustrates a top view of the conveyor of FIG. 8.

Referring to FIGS. 1, 8 and 9, a second conveyor 55 is provided between the grind station 13 and the wash station 14 in order to transfer a ground wafer to the wash station 14. As indicated, the conveyor 55 includes a chuck 56 such as a vacuum chuck, for receiving a ground wafer from the chuck 27 of the grind station 13. The conveyor 55 also includes means for moving the chuck 56 between the grind station 13 and the wash station 14 and means for moving the chuck 56 vertically so as to pick up a wafer on the chuck 27 in the grinding station 13 and to deposit the ground wafer onto the chuck 31 of the wash station 14.

The means for moving the chuck 56 horizontally includes a rotary actuator 57 which pivots the chuck 56 via an arm assembly 58 between the grinding station 13 and wash station 14. The means for moving the chuck 56 vertically includes an air cylinder 59 which operates a rod clevis 60 to move an extension plate 61 on which a mount 62 of the rotary actuator 57 is mounted.

The extension plate 61 carries a carriage 63 which rides on a vertical rail guide 64 on a fixed vertical support 65 between the shock absorber units 66 mounted on the support 65 to limit the vertical motion of the chuck 56.

Referring to FIG. 1, the output station 15 may be provided to receive one or more cassettes 18' for receiving one or more stacks of ground wafers. Basically, the output station 15 is constructed in a similar manner to the input station 11. In this regard, stacks of empty cassettes may be disposed vertically and/or horizontally relative to each other on suitable platforms.

Referring to FIG. 1, the control means 17 includes a keyboard for inputting information, as well as a monitor 34 for visually displaying information which is inputted from the keyboard 33 or information inputted from the measuring station 12.

In order to grind a single wafer, the robot 16 is programmed so that the spatula arm 22 moves into a cassette 18 in the input station 11 to pick up a wafer. The arm 22 is then moved via the articulated lever means 23 to deposit the wafer on the chuck 19 of the measuring station 12. The chuck 19 is then rotated so that the probe 21 scans the peripheral edge of the wafer so as to deliver corresponding signals to the processing means (not shown). Based upon the signals, the actual size and shape of the wafer is determined. At the same time, the geometric center of the wafer is determined from the information received. The chuck 19 is then rotated so as to place the geometric center on the rectilinear path leading to the grind station 13.

Next, the control means 17 programs the conveyor 49 to pick up and move the wafer from the chuck 19 of the measuring station 12 to the chuck 27 of the grind station 13. Thereafter the control means 17 programs the grind station 13 to carry out a grinding program in order to grind the wafer to the desired size and shape. During this time, the grind wheel 28 moves towards the wafer and grinds the diameter and flat (or flats) to the user entered dimensions. The grind burr 30 also moves towards the wafer to grind the notch, if desired.

During the measurement process, the thickness of the wafer is also measured at the center point by the non-contact sensors 47, 48. This information is also delivered to the control means 17 and may be visualized on the monitor 34.

Next, the second conveyor 55 is actuated to move the ground wafer from the chuck 27 of the grind station 13 to the chuck 31 of the wash station 14. After being deposited on the chuck 31, the wafer is rotated at a high speed while being wetted on the top and bottom surfaces by the rinsing liquid delivered via the nozzle of the washing means (not shown). After the wafer has been wet, air is blown onto the wafer via the air blow means (not shown) to dry the top and bottom surfaces while the wafer is still being rotated at high speed.

Thereafter, the clean and dried wafer is lifted off the spin drying chuck 31 via the chuck of the second conveyor 55 so that the spatula arm 22 of the robot 16 may receive the wafer.

Next, the robot 16 is programmed so that the arm 22 moves to the wash station 14, receives the dried wafer and either moves the wafer back to the measuring station 12 or moves the wafer directly to a cassette 18' in the output station 15. In this respect, each wafer of a series of wafers being ground may be directed back into the measuring station 12 to obtain an after grind measurement. Alternatively, the ground wafers may be selected on a random basis or on a programmed basis for return to the measuring station 12 for post measurement. For example, if every fifth wafer conforms to the user inputted dimensions, it may be assumed that all of the intermediate wafers have been accurately ground. Hence, there is no need to measure each wafer.

After a ground wafer has been returned to the measuring station 12 for an after-grind wafer measurement, the wafer is again rotated one complete revolution on the chuck 19 while the wafer edge is detected by the non-contact sensor. This again provides wafer measurements including diameter, flat length(s) and notch depth as well as exactly determining the orientation of the wafer on the probe chuck 19. The thickness of the wafer may also be measured. The results are then directed to the processing means to determine conformance with the user inputted dimensions. If the dimensions are accurate, then the wafer is moved from the probe chuck 19 via the robot arm 22 into a cassette 18' and the output station 15.

In the event that a ground wafer is not ground to the desired measurements, the machine can be stopped with an alert given to the operator. Alternatively, the location of the wafer may be electronically marked by the control means 17 and the position of this wafer in the output cassette 18' noted. The "defective" wafer being thus labelled can be processed at a downstream point by either being removed and recycled for regrinding, if such remains possible, or otherwise eliminated.

During inspection, an unground wafer which has been measured need only be picked up and moved by the conveyor 49 a short distance to permit the inspection of a ground wafer on the chuck 19. For example, the two wafers may overlap with only a small crescent-shaped part of the wafer on the chuck 19 exposed to the probe means 21.

The above is a typical sequence of processing a single wafer in the machine 10. In this regard, the estimated cycle time for a wafer is the grind time plus thirteen (13) seconds. The grind time is dependent on the grinding feed rate (grind chuck speed), number of passes, grinding of the notch and the grind mode (profile or trapezoidal). Since a flat grind stage is eliminated, the grind time should be independent of the number of flats. For example, the grind time may be approximately 15 seconds per pass.

During grinding of a series of delivered wafers, while one wafer is being ground in the grind stage 13, another wafer may be delivered from the input station 11 to the measuring station 12 for measurement purposes. Thereafter, this wafer may be picked up by the transfer conveyor and moved towards the grind station 13 into a holding position. Thereafter, the robot 16 may be programmed to pick up a wafer from the wash station 14 for movement into the measuring station 12 for after grind-measurements. This wafer can then be transferred to the output station 15. Thus, while a wafer is being ground in the grind station, a second wafer may be held in a holding position between the measuring station and the grind station while a third wafer is transferred from the wash station to the measuring station for after grind measurements. This third wafer can then be moved into the output station. A fourth wafer is then transferred from the input station to the measuring station.

The grinding machine is capable of grinding wafers, for example, to a diameter in the range of from 125 millimeters to 200 millimeters.

The machine may also be programmed to sort ground wafers by thickness depending upon the thickness measurements which are obtained in the measuring station 12.

The machine is capable at operating at a high throughput. For example, 80 plus wafers per hour may be provided with a profile diameter, flat and notch. Higher throughputs without notch grinding may be obtained while lower throughputs are obtained where trapezoidal beveling is programmed into the operation. This is slower because multiple wafer rotations are required for a complete grind.

The machine may be constructed to have a relatively small footprint, for example, approximately 14 square feet. (1.22 $m^2$)

The machine is capable of a high yield. That is to say, the automated inspection of a ground wafer immediately points out any problem.

Further, a closed loop system on the moving stages (conveyors) further assures proper operation.

The machine cost can be held to a relative minimum. In this respect, the machine operates with few costs. Also, the sub-systems of the machine lead to decreased development, decreased manufacturing costs, decreased machine lead time, low mean time to repair and an increase in mean time between failures.

Each motor for the respective conveyors 49, 55 as well as the motors for the robot 16 may use a closed loop positioning system. This assures that an axis moves to the correct position. Further, use is made of AC or DC motors. This results in higher axis speeds and motion smoothness as compared to stepping motors.

The machine may also be used to grind wafers such as computer hard discs. In this case, the machine may be programmed to grind not only the outer diameter of the hard disc but also the inner diameter.

The machine may be provided with a user interface to permit the operator to change machine parameters, inspection tolerance, desired ground geometry and grinding speeds through the keyboard of the controller. This also gives the operator access to wafer measurements and provides the ability to move individual machine components or systems independently of the cycle.

During operation, a wafer which is removed from a particular slot of a cassette is located into the same numbered slot of a different cassette.

The machine may be constructed with various options for the input station 11 and output station 15. For example, the machine may have two or four send cassettes at the input station and two or four receive cassettes at the output station.

Further, the machine may be constructed with two input cassettes and four water tanks or four input cassettes and four water tanks.

In the alternative, the machine may be modified so as to employ input and output stations which employ a conveyor belt system, for example, as described in U.S. Pat. No. 4,638,601.

The machine may also be provided with a printer or host computer so as to send information from the grinder to the printer or host computer.

The machine may be easily converted with respect to the size and shape of the wafer desired. That is, the machine can be converted to different wafer types by changing only the grind chuck and the user enter variables or recipes. In this respect, the recipes may constitute 100 or more user defined grinding programs.

The machine may also be provided with a communication protocol for SECS I and SECS II.

SECS stands for Semi Equipment Communications Standard.

SECSI is the standard for how to transfer messages from a piece of equipment (the machine) to the user's central computer system.

SECSII is the standard of the equipment's message content.

The purpose behind SECS is to have a generic communication standard for all machine equipment. This is the basic step to factory automation.

It is noted that the thickness measurement of the wafer determines the vertical position of the grind wheel 28 of grind stage 13 so that the desired form is placed properly on the edge of the wafer during grinding.

What is claimed is:

1. A wafer grinding machine comprising a wafer measuring station for determining the size and shape of a wafer delivered thereto;

a grind station spaced from said wafer measuring station for grinding an edge of a wafer received therefrom to a predetermined size and shape;

a wash station for washing an edge-ground wafer received from said grind station;

a robot disposed centrally of said stations and having an arm for conveying a wafer thereon; and control means for programming said robot to move said arm between said wash station and said measuring station to deliver a ground wafer thereto for inspection of the accuracy of the ground edge of the wafer.

2. A wafer grinding machine as set forth in claim 1 which further comprises at least one wafer input station for holding a stack of wafers, and wherein said control means programs said robot to move said arm between said input station and said measuring station.

3. A wafer grinding machine as set forth in claim 1 which further comprises at least one wafer output station for holding a stack of wafers, and wherein said control means programs said robot to selectively move said arm between said wash station and said output station and to move said arm sequentially from said wash station to said measuring station and then to said output station.

4. A wafer grinding machine as set forth in claim 1 which further comprises a first conveyor for moving a wafer from said measuring station to said grind station along a rectilinear path and a second conveyor for moving a ground wafer from said grind station to said wash station transversely of said rectilinear path.

5. A wafer grinding machine as set forth in claim 4 wherein said grind station includes a rotatable chuck for holding and rotating a wafer thereon about a first vertical axis perpendicular to and in said rectilinear path, a grind wheel to rotate about a second axis parallel to said first vertical axis, means for moving said grind wheel towards and away from said chuck to grind a peripheral edge of a wafer on said chuck, a grind burr rotatable about a third axis parallel to said first axis and in said rectilinear path, and means to move said grind burr along said rectilinear path to grind a notch in a wafer on said chuck.

6. A wafer grinding machine as set forth in claim 5 wherein said grind wheel has at least a pair of peripheral grind grooves disposed in vertical relation, one of said grooves being sized to provide a coarse grind and the other of said grooves being sized to provide a fine grind and means for moving said grind wheel vertically to align a respective groove with a wafer on said chuck.

7. A wafer grinding machine as set forth in claim 4 wherein said measuring station includes a rotatable chuck for receiving and rotating a wafer thereon, a sensor for scanning the edge of a wafer rotated with said chuck and generating a sequence of signals in response thereto, and processing means for determining the size, shape and geometric center of the wafer on said chuck from said signals.

8. A wafer grinding machine as set forth in claim 7 wherein said chuck is connected to said processing means to receive a signal therefrom to rotate said chuck to place the geometric center of a received wafer on said rectilinear path.

9. A wafer grinding machine as set forth in claim 1 wherein said robot has an articulated lever means rotatable about a central vertical axis and having said arm mounted on one end thereof for movement with three degrees of freedom.

10. A wafer grinding machine as set forth in claim 9 wherein said lever means includes a pair of levers, one of said levers being rotatably mounted on said vertical axis and pivotally connected to the other of said levers, said other lever having said arm pivotally mounted at a free end thereof.

11. A wafer grinding machine as set forth in claim 1 wherein said measuring station includes means for measuring the thickness of a wafer in said measuring station.

12. A wafer grinding machine as set forth in claim 11 wherein said wafer measuring station has a rotatable chuck for receiving a wafer thereon and thickness measuring means includes a sensor disposed over a central portion of said chuck to measure the thickness of a wafer thereat.

13. A wafer grinding machine comprising at least one wafer input station for holding a stack of wafers;

a wafer measuring station having probe means for measuring a wafer received from said input station to obtain a geometric center of the received wafer and to place the geometric center of the received wafer on a first predetermined path extending from said measuring station;

a grind station in said path for receiving a wafer from said measuring station and grinding a peripheral edge of the wafer to a predetermined shape and size;

a wash station for receiving an edge-ground wafer from said grind station;

a conveyor for moving a ground wafer from said grind station to said wash station in a second path angularly disposed to said first path;

at least one output station for holding a stack of ground wafers;

a robot disposed centrally of said stations, said robot having an arm for conveying a wafer thereon and lever means for moving said arm with three degrees of freedom, said lever means being rotatable about a central vertical axis; and control means for programming said robot to move said arm from a position receiving a wafer from said input station to a position placing the wafer in said wafer measuring station.

14. A wafer grinding machine as set forth in claim 13 wherein said control means programs said robot to selectively move a washed ground wafer from said wash station to said wafer measuring station to inspect the accuracy of the ground wafer.

15. A wafer grinding machine as set forth in claim 13 wherein said control means programs said robot to selectively move a wafer from said wash station to said output station for subsequent removal or from said wash station to said measuring station and thereafter to said output station.

16. A wafer grinding machine as set forth in claim 13 which further comprises a conveyor for moving a wafer from said measuring station to said grind station along said first path.

17. A wafer grinding machine as set forth in claim 16 wherein said first path is a rectilinear path.

18. In an automatic edge grinder, the combination comprising at least one wafer input station for holding a vertical stack of wafers;

a wafer measuring station for determining the size and shape of a wafer delivered thereto;

a grind station spaced from said wafer measuring station for grinding an edge of a wafer received therefrom to a predetermined size and shape;

a robot having an arm for conveying a wafer thereon; and control means for programming said robot to move said arm from said input station to said measuring station to deliver a wafer thereto and to move said arm with a ground wafer thereon to said measuring station for an after grinding measurement.

19. The combination as set forth in claim 18 wherein said control means programs said robot to move said arm vertically relative to said input station.

20. In an automatic edge grinder, the combination comprising a grind station for grinding an edge of a wafer to a predetermined size and shape; and a wash station for washing an edge-ground wafer received from said grind station, said wash station including a chuck for receiving a ground wafer thereon, means for rinsing a wafer on said chuck, means for rotating said chuck to spin-dry a rinsed wafer thereon and means for blowing air onto the wafer on said chuck to air dry the wafer.

21. A method of edge grinding a series of wafers comprising the steps of moving a first wafer into a measuring station to measure at least the actual shape, size and location of the wafer;

moving the measured first wafer from the measuring station into a grind station for grinding a peripheral edge of the wafer to a predetermined size and shape;

placing the edge ground wafer into a wash station to clean debris from the ground wafer; and selectively moving the cleaned wafer from said wash station into the measuring station to measure the size and shape of the ground wafer or from said wash station into an output station.

22. A method as set forth in clam 21 which further comprises the steps of moving a second wafer from an input station into said measuring station with the first wafer in said grind station.

23. A method as set forth in claim 22 which further comprises the step of moving a third wafer into said measuring station with the first wafer in said wash station and the second wafer in said grind station.

24. A method as set forth in claim 21 which further comprises the step of moving a ground wafer from said measuring station to the output station.

25. A wafer grinding machine comprising a wafer input station for receiving a cassette of wafers;

a wafer measuring station for determining the geometric center of a wafer delivered thereto;

a grind station spaced from said wafer measuring station for grinding an edge of a wafer received therefrom to a predetermined size and shape;

a wash station for washing an edge-ground wafer received from said grind station;

a robot having an arm for conveying a wafer thereon; and control means for programming said robot to move said arm from said input station to said measuring station to deliver a wafer to said measuring station and to move said arm from said wash station to said measuring station to deliver a ground wafer thereto for inspection of the accuracy of the ground edge of the wafer.

26. A wafer grinding machine as set forth in claim 25 wherein said grind station includes a rotatable chuck for holding and rotating a wafer thereon about a first axis, a grind wheel to rotate about a second axis parallel to said first axis, means for moving said grind wheel towards said chuck to grind a peripheral edge of a wafer on said chuck, a grind burr rotatable about a third axis parallel to said first axis, and means to move said grind burr to grind a notch in a wafer on said chuck.

27. A wafer grinding machine as set forth in claim 25 wherein said measuring station includes a rotatable chuck for receiving and rotating a wafer thereon, a sensor for scanning the edge of a water rotated with said chuck and generating a sequence of signals in response thereto, and processing means for determining the geometric center of the wafer on said chuck from said signals.

28. A wafer grinding machine as set forth in claim 27 wherein said measuring station includes means for measuring the thickness of a wafer in said measuring station.

29. A wafer grinding machine as set forth in claim 25 which further comprises an output station for a cassette to receive a plurality of wafers and wherein said control means programs said robot arm to move a wafer from said wash station to said measuring station and thereafter to said output station.

30. A wafer grinding machine as set forth in claim 25 wherein said wash station includes a chuck for receiving a ground wafer thereon, means for rinsing a wafer on said chuck and means for rotating said chuck to spin-dry a rinsed wafer thereon.

31. A wafer grinding machine comprising a wafer input station for receiving a cassette of wafers;

a wafer output station for a cassette to receive ground wafers;

a wafer measuring station for determining the geometric center of a wafer delivered thereto;

a grind station spaced from said wafer measuring station for grinding an edge of a wafer received therefrom to a predetermined size and shape;

a wash station for washing an edge-ground wafer received from said grind station;

a robot having an arm for conveying a wafer thereon; and control means for programming said robot to move said arm from said input station to said measuring station to deliver a wafer to said measuring station, to move said arm from said wash station to said measuring station to deliver a ground wafer thereto for inspection of the accuracy of the ground edge of the wafer, and to move said arm from said measuring station to said output station to deliver a ground and inspected wafer thereto.

32. A wafer grinding machine as set forth in claim 31 wherein said wash station includes a chuck for receiving a ground wafer thereon, means for rinsing a wafer on said chuck and means for rotating said chuck to spin-dry a rinsed wafer thereon.

33. A wafer grinding machine as set forth in claim 31 wherein each said station includes a rotatable vacuum chuck for receiving a ground wafer thereon, a washing means for spraying water onto a wafer on said vacuum chuck to rinse debris from the wafer, and a motor for rotating said vacuum chuck to spin dry a wafer thereon.

* * * * *